US011813876B2

(12) United States Patent
Kawamata et al.

(10) Patent No.: US 11,813,876 B2
(45) Date of Patent: Nov. 14, 2023

(54) PRINTER, CONTROL METHOD, AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya (JP)

(72) Inventors: Noriyuki Kawamata, Nagoya (JP); Shuichi Tamaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 16 days.

(21) Appl. No.: 17/681,271

(22) Filed: Feb. 25, 2022

(65) Prior Publication Data

US 2022/0297440 A1 Sep. 22, 2022

(30) Foreign Application Priority Data

Mar. 22, 2021 (JP) ..... 2021-047125

(51) Int. Cl.
*B41J 2/175* (2006.01)
*B41J 2/165* (2006.01)

(52) U.S. Cl.
CPC ..... *B41J 2/17596* (2013.01); *B41J 2/16508* (2013.01); *B41J 2/16523* (2013.01); *B41J 2/16532* (2013.01); *B41J 2002/1657* (2013.01); *B41J 2002/16573* (2013.01); *B41J 2002/16594* (2013.01)

(58) Field of Classification Search
CPC ..... B41J 2/17596; B41J 2/16508; B41J 2/16523; B41J 2/16532; B41J 29/393; B41J 2002/1657; B41J 2002/16573; B41J 2002/16594; B41J 2/1721; B41J 2/165
See application file for complete search history.

(56) References Cited

U.S. PATENT DOCUMENTS 6,481,824 B1 11/2002 Hitoshi et al.
2002/0085060 A1* 7/2002 Usui ..... B41J 2/16508 347/30

FOREIGN PATENT DOCUMENTS

JP H11348310 A 12/1999
JP 2004216797 A 8/2004

* cited by examiner

*Primary Examiner* — Julian D Huffman
(74) *Attorney, Agent, or Firm* — K&L Gates LLP

(57) ABSTRACT

A printer is provided with a first supply flow channel configured to connect a head with a first tank, a second supply flow channel configured to connect the head with a second tank, a first supply valve provided at the first supply flow channel, a second supply valve provided at the second supply flow channel, a cap configured to cover the first nozzle hole and the second nozzle hole and to be closely adhered to a nozzle surface of the head, a pump provided at a waste liquid flow channel connected to the cap. The processor of the printer drives the pump in a state in which the cap is closely adhered to the nozzle surface, one of the first supply valve or the second supply valve is open, and the other of the first supply valve or the second supply valve is closed.

18 Claims, 8 Drawing Sheets

PRINTER, CONTROL METHOD, AND NON-TRANSITORY COMPUTER-READABLE MEDIUM STORING COMPUTER-READABLE INSTRUCTIONS

CROSS-REFERENCE TO RELATED APPLICATIONS

This application claims priority to Japanese Patent Application No. 2021-047125 filed Mar. 22, 2021. The contents of the foregoing application are hereby incorporated herein by reference.

BACKGROUND

The present disclosure relates to a printer, a control method, and a non-transitory computer-readable medium storing computer-readable instructions.

An inkjet recording device is provided with a sub-tank and a head. An ink is stored in the sub-tank. The ink is supplied to the head from the sub-tank via a supply flow channel. The head discharges the ink from a nozzle hole. Further, the inkjet recording device is provided with a capping portion, a waste ink tank, and a suction pump. The capping portion can cap the nozzle holes. The waste ink tank is connected to the capping portion via a waste liquid flow channel. The suction pump is provided at the waste liquid flow channel. In order to recover a discharge capability of the nozzle hole, the inkjet recording device drives the suction pump in a state in which the nozzle hole is capped by the capping portion to perform purging. As a result, the ink is sucked from the nozzle hole and discharged from the capping portion into the waste ink tank via the waste liquid flow channel.

SUMMARY

It is conceivable that the above-described inkjet recording device has a configuration in which a first sub-tank and a second sub-tank are provided. In this case, a first supply flow channel and a second supply flow channel are provided. The first supply flow channel is connected to the first sub-tank. The second supply flow channel is connected to the second sub-tank. The head is provided with a first nozzle hole and a second nozzle hole. The first nozzle hole discharges an ink supplied from the first supply flow channel. The second nozzle hole discharges an ink supplied from the second supply flow channel. In this case, a resistance difference may arise between the first supply flow channel and the second supply flow channel when the inks flow.

For example, sub-tanks may store inks having mutually different viscosities, respectively. In this case, a resistance in a supply flow channel of the ink having a higher viscosity is higher than a resistance in a supply flow channel of the ink having a lower viscosity. For example, when replacing a component of the head, a component of the supply flow channel, or the like, air may be mixed into the supply flow channel. In this case, a resistance in a supply flow channel with a larger amount of the mixed air is higher than a resistance in a supply flow channel with no mixed air or a smaller amount of the mixed air. Further, since the replaced component is not wettened with the ink, the resistance may be higher at a position at which the replaced component is disposed. The longer the supply flow channels, the larger the resistance difference between the respective supply flow channels becomes.

In the above-described inkjet recording device, when a large amount of the ink is stored in the sub-tank, or the like, it is conceivable that the inkjet recording device has a configuration in which the sub-tank is disposed at a position separated from the head. In this case, each of the supply flow channels is likely to become longer compared with a case in which the sub-tank is disposed near the head. Thus, the resistance difference between the respective supply flow channels is likely to become large.

Further, in the above-described inkjet recording device, it is conceivable that all the nozzle holes are capped by the single capping portion. In this case, when the purging is performed in a state in which there is a resistance difference between the first supply flow channel and the second supply flow channel, the ink is more likely to be discharged from the supply flow channel with the lower resistance, and is less likely to be discharged from the supply flow channel with the higher resistance. Thus, it is more difficult to recover the discharge capability of the nozzle holes corresponding to the supply flow channel with the higher resistance than that of the nozzle holes corresponding to the supply flow channel with the lower resistance.

Embodiments of the broad principles derived herein provide a printer, a control method, and a non-transitory computer-readable medium storing computer-readable instructions capable of recovering a discharge capability of nozzle holes regardless of a resistance difference between respective supply flow channels.

A first aspect of the present disclosure relates to a printer. The printer includes a first tank and a second tank configured to store ink, a first supply flow channel configured to connect a head with the first tank, a second supply flow channel configured to connect the head with the second tank, a first supply valve provided at the first supply flow channel, a second supply valve provided at the second supply flow channel, a nozzle surface provided with a first nozzle hole configured to discharge the ink supplied from the first supply flow channel and a second nozzle hole configured to discharge the ink supplied from the second supply flow channel, a cap configured to cover the first nozzle hole and the second nozzle hole and to be closely adhered to the nozzle surface, a pump provided at a waste liquid flow channel connected to the cap, a processor; and a memory storing computer-readable instructions that, when executed by the processor, cause the processor to perform a process. The nozzle surface being a surface provided at the head. The process includes first purge processing of driving the pump in a state in which the cap is closely adhered to the nozzle surface, one of the first supply valve or the second supply valve is open, and the other of the first supply valve or the second supply valve is closed.

In the first purge processing, the pump is driven in a state in which one of the first supply valve and the second supply valve is open and the other of the first supply valve and the second supply valve is closed. Thus, the ink is discharged from the nozzle hole corresponding to the open supply valve regardless of a resistance difference between the first supply flow channel and the second supply flow channel. As a result, the printer can recover the discharge capability of the nozzle hole corresponding to the open supply valve. Thus, the printer can recover the discharge capability of the nozzle hole regardless of the resistance difference between the first supply flow channel and the second supply flow channel.

A second aspect of the present disclosure relates to a control method. The control method includes first purge processing of driving a pump provided at a waste liquid flow channel. The waste liquid flow channel is connected to a cap.

The cap is configured to cover a first nozzle hole and a second nozzle hole of a nozzle surface provided at a head. The cap is configured to be closely adhered to the nozzle surface. The first nozzle hole is configured to discharge ink supplied from a first supply flow channel connecting the head and a first tank. The second nozzle hole is configured to discharge ink supplied from a second supply flow channel connecting the head and a second tank. The first purge processing is performed in a state in which the cap is closely adhered to the nozzle surface, and in which one of a first supply valve provided in the first supply flow channel or a second supply valve provided in the second supply flow channel is open, and the other of the first supply valve or the second supply valve is closed.

The second aspect can achieve the same effects as those of the first aspect.

A third aspect of the present disclosure relates to a non-transitory computer-readable medium storing computer-readable instructions that, when executed by a computer, cause the computer to perform a process. The process includes first purge processing of driving a pump provided at a waste liquid flow channel. The waste liquid flow channel is connected to a cap. The cap is configured to cover a first nozzle hole and a second nozzle hole of a nozzle surface provided at a head. The cap is configured to be closely adhered to the nozzle surface. The first nozzle hole is configured to discharge ink supplied from a first supply flow channel connecting the head and a first tank. The second nozzle hole is configured to discharge ink supplied from a second supply flow channel connecting the head and a second tank. The first purge processing is performed in a state in which the cap is closely adhered to the nozzle surface, and in which one of a first supply valve provided in the first supply flow channel or a second supply valve provided in the second supply flow channel is open, and the other of the first supply valve or the second supply valve is closed.

The third aspect can achieve the same effects as those of the first aspect.

BRIEF DESCRIPTION OF THE DRAWINGS

Embodiments will be described below in detail with reference to the accompanying drawings in which.

DETAILED DESCRIPTION

Figure 1:
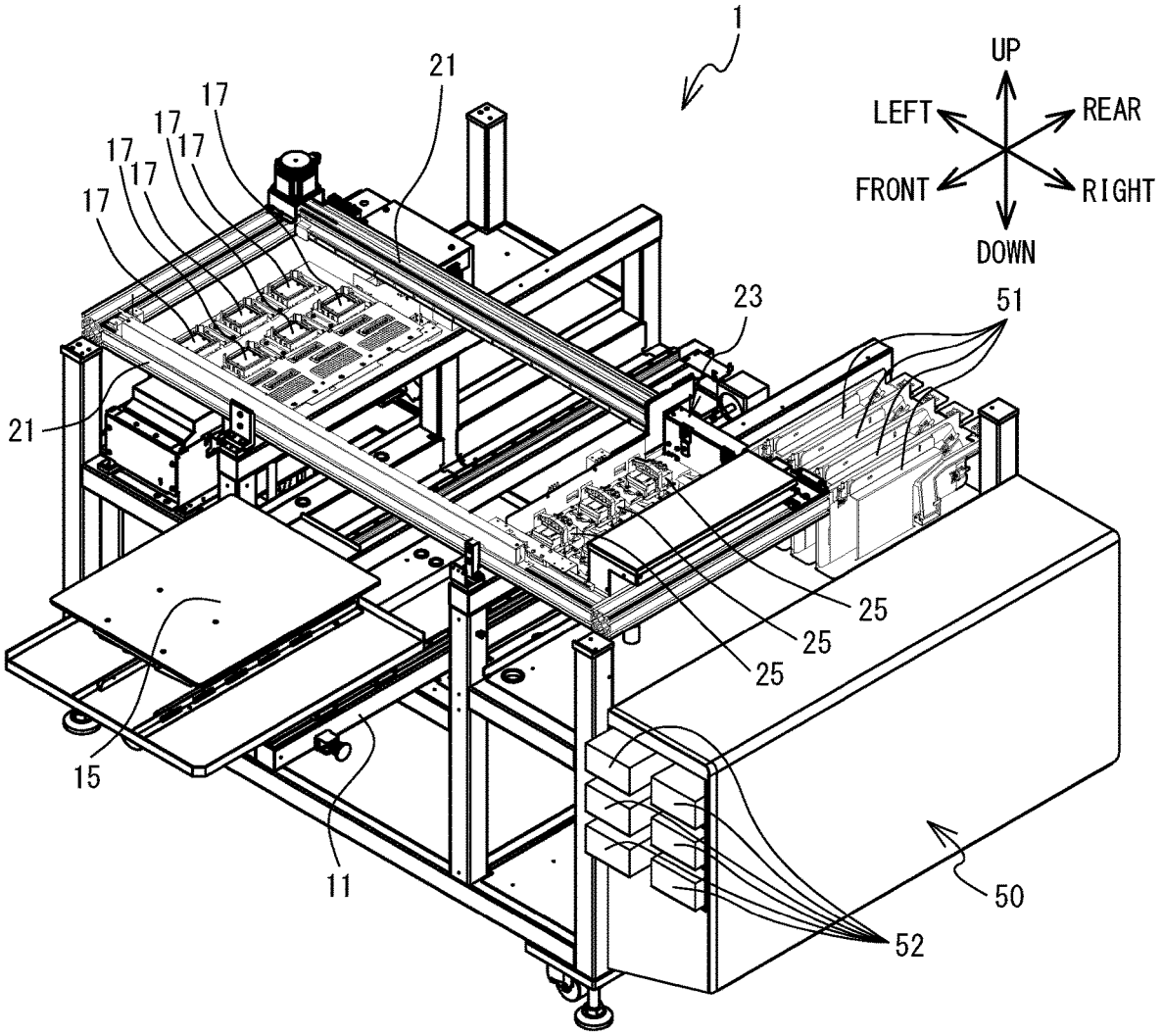
FIG. 1 is a perspective view of a printer when seen from the front right and above.

With reference to the drawings, a printer 1 according to an embodiment of the present disclosure will be described. A lower left side, an upper right side, a lower right side, an upper left side, an upper side, and a lower side correspond to a front side, a rear side, a right side, a left side, an upper side, and a lower side of the printer 1, respectively. In the present embodiment, mechanical elements in the drawings are illustrated in accordance with an actual scale.

The printer 1 illustrated in FIG. 1 is an inkjet printer, and performs printing on a print medium (not illustrated in the drawings) by discharging ink. The print medium is a fabric, paper, or the like, and is, for example, a T-shirt. As an example, the printer 1 can print a color image on the print medium using inks of five colors, namely, white (W), black (K), yellow (Y), cyan (C), and magenta (M).

In the following description, of the inks of the five colors, the ink having the white color will be referred to as "white ink", and the inks having the four colors, namely, the black, the cyan, the yellow, and the magenta will be referred to as "black ink", "cyan ink", "yellow ink", and "magenta ink", respectively. When the black ink, the cyan ink, the yellow ink, and the magenta ink are collectively referred to, or when it is not specified which one of the four colors is referred to, the ink or the inks will be simply referred to as "color ink" or "color inks". When the white ink and the color inks are collectively referred to, or when it is not specified which one of the five colors is referred to, the ink or the inks will be simply referred to as "ink" or "inks".

As illustrated in FIG. 1, the printer 1 is provided with a conveyer 11 and a pair of guide rails 21. The conveyer 11 extends in a front-rear direction, and supports a platen 15. The print medium (not illustrated in the drawings) is placed on the upper surface of the platen 15. The platen 15 is conveyed in the front-rear direction along the conveyer 11 by the driving of a sub-scanning motor 32 illustrated in FIG. 3. Thus, in the present embodiment, the front-rear direction is a sub-scanning direction.

The pair of guide rails 21 extend in the left-right direction, and supports a carriage 23. The carriage 23 is located above the platen 15. The head 25 is mounted on the carriage 23. A number of the heads 25 is not limited to a particular number, but is six as an example. Note that only three of the heads 25 disposed side by side in the front-rear direction are illustrated in FIG. 1.

Figure 3:
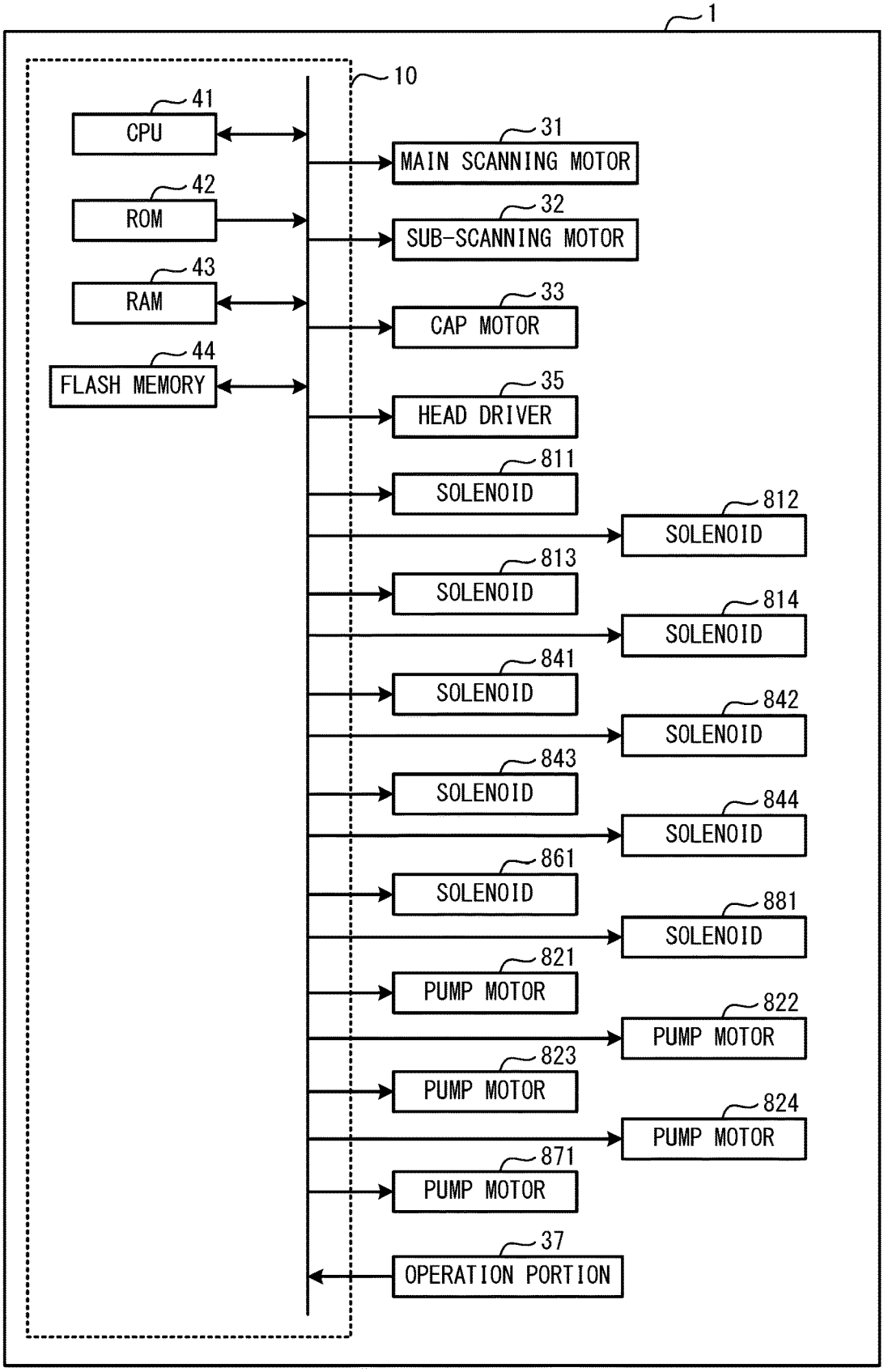
FIG. 3 is a block diagram illustrating an electrical configuration of the printer.

The plurality of heads 25 discharge the color ink, the white ink, a pre-treatment agent, a special paint, or the like, respectively, using the driving of a head driver 35 illustrated in FIG. 3. Since the structure of each of the plurality of heads 25 is the same, the structure of the head 25 that discharges the color inks will be described as an example.

Figure 2:
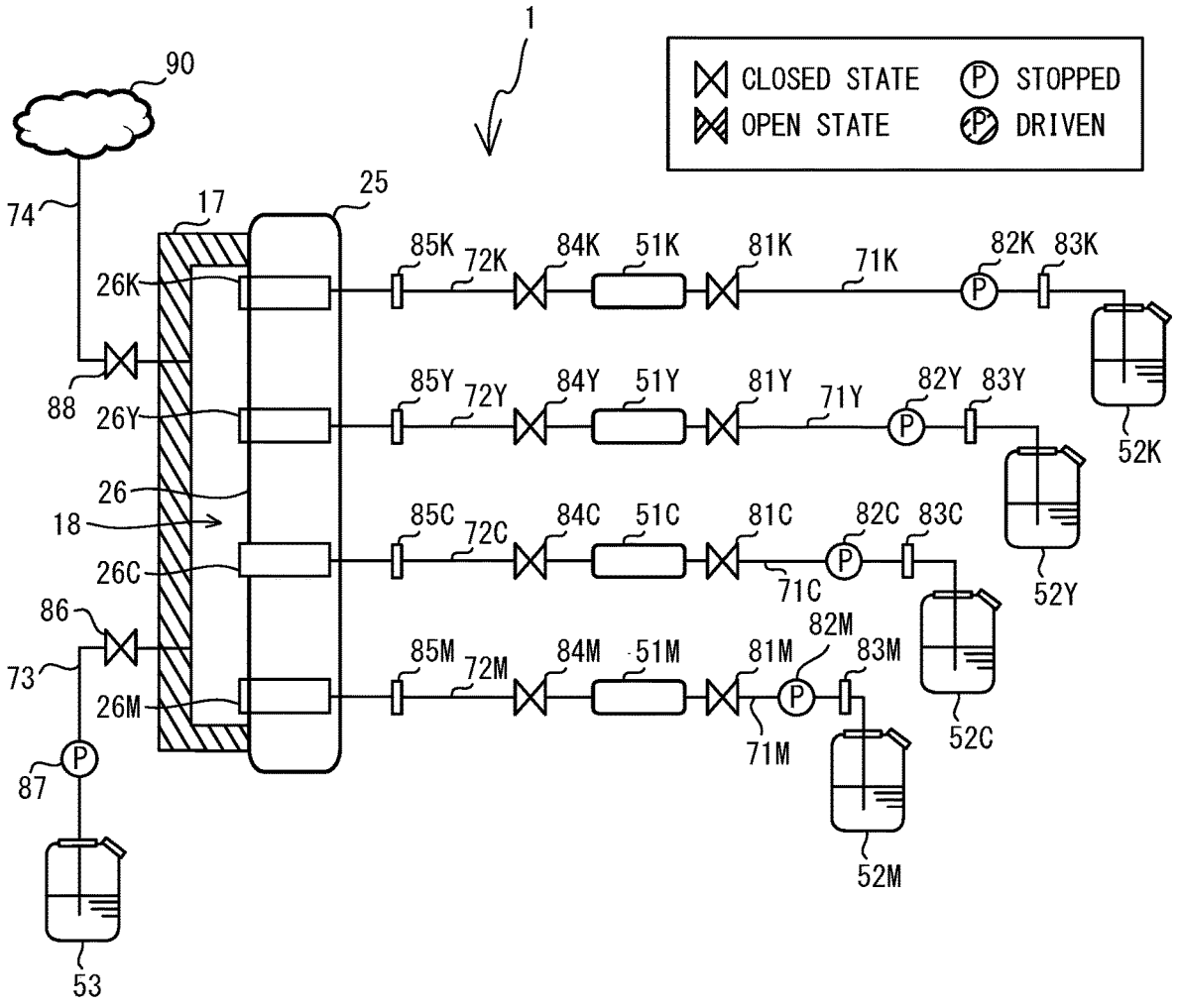
FIG. 2 is a flow channel configuration diagram of color inks in an initial state.

The head 25 has a cuboid shape. A nozzle surface 26 illustrated in FIG. 2 is provided at the lower surface of the head 25. A plurality of nozzle holes are formed in the nozzle surface 26. In the present embodiment, as an example, four nozzle holes 26K, 26Y, 26C, and 26M illustrated in FIG. 2 are formed in the nozzle surface 26. The head 25 discharges the black ink, the yellow ink, the cyan ink, and the magenta ink from the nozzle holes 26K, 26Y, 26C, and 26M, respectively.

The carriage 23 is conveyed in the left-right direction along the pair of guide rails 21 by the driving of a main scanning motor 31 illustrated in FIG. 3. As a result, the head 25 is also conveyed in the left-right direction. Thus, in the present embodiment, the left-right direction is a main scanning direction.

According to the configuration described above, the printer 1 causes the platen 15 to move from the front to the rear using the driving of the sub-scanning motor 32 illustrated in FIG. 3. After that, while causing the platen 15 to move from the rear to the front using the driving of the sub-scanning motor 32 illustrated in FIG. 3, the printer 1 causes the carriage 23 to reciprocate in the left-right direction using the driving of the main scanning motor 31 illustrated in FIG. 3. The head 25 discharges the inks while scanning in the left-right direction. In this manner, by discharging the inks from the head 25 while conveying the print medium placed on the platen 15 in the front-rear direction and the left-right direction with respect to the head 25, the printer 1 prints a print image on the print medium.

A cap 17 is provided at a position on the left side of a movement path of the platen 15 and below a movement path of the head 25. A number of the caps 17 corresponds to the number of heads 25, and is six as an example. The caps 17 are disposed at positions corresponding to arrangement positions of the heads 25.

The cap 17 is moved in an up-down direction by the driving of a cap motor 33 illustrated in FIG. 3. After the printing is completed, the head 25 is conveyed to the left side of the movement path of the platen 15 by the carriage 23. As a result, the head 25 is disposed above the cap 17. By driving the cap motor 33 illustrated in FIG. 3 in this state, the cap 17 is moved upward. In this case, the cap 17 covers all the nozzle holes 26K, 26Y, 26C, and 26M from below, and closely adheres to the nozzle surface 26. At the time of printing, by driving the cap motor 33, the cap 17 is moved downward and separated from the nozzle surface 26.

In the following description, a state, as illustrated in FIG. 2, in which the cap 17 covers all the nozzle holes 26K, 26Y, 26C, and 26M and closely adheres to the nozzle surface 26 will be referred to as a "closely adhered state". When the cap 17 is in the closely adhered state, a cap space 18 is formed between the cap 17 and the nozzle surface 26. In the "closely adhered state" in which the cap 17 closely adheres to the nozzle surface 26, it is sufficient that the cap 17 and the nozzle surface 26 are not separated from each other during purge processing, such as single color purge processing or all color purge processing, which will be described below. For example, in the "closely adhered state", the cap 17 can maintain a pressure difference between the inside and the outside of the cap space 18.

As illustrated in FIG. 1, a housing portion 50 is provided in a right portion of the printer 1. A plurality of main tanks 52 are housed in the housing portion 50. A plurality of sub-tanks 51 are disposed in the right portion of the printer 1 and to the rear of the guide rail 21. Specifically, the plurality of main tanks 52 and sub-tanks 51 are so-called off-carriage tanks that are not mounted on the carriage 23. The plurality of sub-tanks 51 are preferably all provided at the same height, but an orientation of each of the plurality of sub-tanks 51 in the horizontal direction is not limited.

The main tank 52 is constituted by a cartridge or a tank. The sub-tank 51 is constituted by a pouch, for example, and has flexibility. Each of the plurality of main tanks 52 and sub-tanks 51 stores the ink. In the present embodiment, the main tanks 52 include main tanks 52K, 52Y, 52C, and 52M illustrated in FIG. 2. The sub-tanks 51 include sub-tanks 51K, 51Y, 51C, and 51M illustrated in FIG. 2.

Since the main tanks 52 and the sub-tanks 51 are the off-carriage tanks, significant restrictions are less likely to be imposed on the sizes of the main tank 52 and the sub-tank 51, compared with a case in which the main tanks 52 and the sub-tanks 51 are so-called on-carriage tanks that are mounted on the carriage 23. Thus, compared with the on-carriage tank, the main tanks 52 and the sub-tanks 51 more easily store a large amount of the ink.

With reference to FIG. 2, a configuration of flow channels of the color inks will be described as an example. In the following description, a state in which a valve is closed will be referred to as a "closed state", and a state in which the valve is open will be referred to as an "open state". In FIG. 2, the valve in the closed state is illustrated by a valve symbol without diagonal lines drawn therein, and the valve in the open state is illustrated by the valve symbol with the diagonal lines drawn therein (the same also applies in FIG. 5 to FIG. 8). In FIG. 2, a pump that is stopped is illustrated by a pump symbol without diagonal lines drawn therein, and a pump that is being driven is illustrated by the pump symbol with the diagonal lines drawn therein (the same also applies in FIG. 5 to FIG. 8).

The printer 1 is provided with the main tanks 52K, 52Y, 52C, and 52M, tank flow channels 71K, 71Y, 71C, and 71M, and the sub-tanks 51K, 51Y, 51C, and 51M. The main tanks 52K, 52Y, 52C, and 52M store the black ink, the yellow ink, the cyan ink, and the magenta ink, respectively. The main tanks 52*k*, 52Y, 52C, and 52M are located at positions furthest upstream in the flow channels of the color inks.

Each of the tank flow channels 71K, 71Y, 71C, and 71M is constituted by a tube, for example, and has flexibility. Upstream ends of the tank flow channels 71K, 71Y, 71C, and 71M are connected to the main tanks 52K, 52Y, 52C, and 52M, respectively. Downstream ends of the tank flow channels 71K, 71Y, 71C, and 71M are connected to the sub-tanks 51K, 51Y, 51C, and 51M, respectively.

Thus, the black ink, the yellow ink, the cyan ink, and the magenta ink flow inside the tank flow channels 71K, 71Y, 71C, and 71M from the main tanks 52K, 52Y, 52C, and 52M toward the sub-tanks 51K, 51Y, 51C, and 51M, respectively. The sub-tanks 51K, 51Y, 51C, and 51M store the black ink, the yellow ink, the cyan ink, and the magenta ink, respectively.

Tank valves 81K, 81Y, 81C, and 81M, tank pumps 82K, 82Y, 82C, and 82M, and tank filters 83K, 83Y, 83C, and 83M are provided at the tank flow channels 71K, 71Y, 71C, and 71M, respectively. The tank valves 81K, 81Y, 81C, and 81M can be switched between the closed state and the open state by the driving of solenoids 811, 812, 813, and 814 illustrated in FIG. 3.

In the closed state, the tank valves 81K, 81Y, 81C, and 81M cause the tank flow channels 71K, 71Y, 71C, and 71M to be in a blocked state, respectively. In the open state, the tank valves 81K, 81Y, 81C, and 81M cause the tank flow channels 71K, 71Y, 71C, and 71M to be in a communicated state, respectively.

The tank pumps 82K, 82Y, 82C, and 82M are provided upstream of the tank valves 81K, 81Y, 81C, and 81M, respectively. The tank pumps 82K, 82Y, 82C, and 82M suck the black ink, the yellow ink, the cyan ink, and the magenta ink from the main tanks 52K, 52Y, 52C, and 52M, respectively, using the driving of pump motors 821, 822, 823, and 824 illustrated in FIG. 3, respectively. The tank pumps 82K, 82Y, 82C, and 82M supply the sucked black ink, yellow ink, cyan ink, and magenta ink toward the sub-tanks 51K, 51Y, 51C, and 51M via the tank flow channels 71K, 71Y, 71C, and 71M, respectively, using the driving of the pump motors 821, 822, 823, and 824 illustrated in FIG. 3.

The tank filters 83K, 83Y, 83C, and 83M are located upstream of the tank pumps 82K, 82Y, 82C, and 82M, and are removably attached to the tank flow channels 71K, 71Y, 71C, and 71M. Each of the tank filters 83K, 83Y, 83C, and 83M is constituted by a non-woven fabric, a woven fabric, resin, a film, or a porous metal piece, for example, and is configured to filter the ink.

The printer 1 is provided with supply flow channels 72K, 72Y, 72C, and 72M. Each of the supply flow channels 72K, 72Y, 72C, and 72M is constituted by a tube, for example, and has flexibility. Upstream ends of the supply flow channels 72K, 72Y, 72C, and 72M are connected to the sub-tanks 51K, 51Y, 51C, and 51M, respectively. Downstream ends of the supply flow channels 72K, 72Y, 72C, and 72M are connected to the head 25.

Since the supply flow channels 72K, 72Y, 72C, and 72M are flexible, they can deform in accordance with the movement of the head 25. A length from the upstream end to the downstream end of each of the supply flow channels 72K, 72Y, 72C, and 72M is longer than a length from a left end to a right end of a movement range of the head 25, for example.

For example, during the printing, the black ink, the yellow ink, the cyan ink, and the magenta ink flow inside the supply flow channels 72K, 72Y, 72C, and 72M from the sub-tanks 51K, 51Y, 51C, and 51M toward the head 25, respectively, due to a water head difference between the sub-tanks 51K, 51Y, 51C, and 51M, and the head 25. The head 25 discharges the black ink, the yellow ink, the cyan ink, and the magenta ink from the nozzle holes 26K, 26Y, 26C, and 26M, respectively.

Supply valves 84K, 84Y, 84C, and 84M and supply filters 85K, 85Y, 85C, and 85M are provided at the supply flow channels 72K, 72Y, 72C, and 72M, respectively. The supply valves 84K, 84Y, 84C, and 84M can be switched between the closed state and the open state by the driving of solenoids 841, 842, 843, and 844 illustrated in FIG. 3.

In the closed state, the supply valves 84K, 84Y, 84C, and 84M cause the supply flow channels 72K, 72Y, 72C, and 72M to be in a blocked state, respectively. In the open state, the supply valves 84K, 84Y, 84C, and 84M cause the supply flow channels 72K, 72Y, 72C, and 72M to be in a communicated state, respectively.

The supply filters 85K, 85Y, 85C, and 85M are located downstream of the supply valves 84K, 84Y, 84C, and 84M, and are removably attached to the supply flow channels 72K, 72Y, 72C, and 72M. Each of the supply filters 85K, 85Y, 85C, and 85M is constituted by a non-woven fabric, a woven fabric, resin, a film, or a porous metal piece, for example, and is configured to filter the ink.

The printer 1 is provided with a waste liquid tank 53 and a waste liquid flow channel 73. The waste liquid tank 53 stores the ink that has not been used for the printing (hereinafter referred to as a "waste liquid 99", refer to FIG. 5). The waste liquid flow channel 73 is constituted by a tube, for example, and has flexibility. One end of the waste liquid flow channel 73 is connected to the cap 17. The other end of the waste liquid flow channel 73 is connected to the waste liquid tank 53. Thus, the waste liquid 99 illustrated in FIG. 5 flows inside the waste liquid flow channel 73 from the cap space 18 toward the waste liquid tank 53.

A waste liquid valve 86 and a waste liquid pump 87 are provided at the waste liquid flow channel 73. The waste liquid valve 86 can be switched between the closed state and the open state by the driving of a solenoid 861 illustrated in FIG. 3. In the closed state, the waste liquid valve 86 causes the waste liquid flow channel 73 to be in a blocked state. In the open state, the waste liquid valve 86 causes the waste liquid flow channel 73 to be in a communicated state.

The waste liquid pump 87 is provided at a position closer to the other end side (the waste liquid tank 53 side) of the waste liquid flow channel 73 than the waste liquid valve 86. The waste liquid pump 87 sucks the waste liquid 99 illustrated in FIG. 5, air, and the like from the cap space 18, using the driving of a pump motor 871 illustrated in FIG. 3. The waste liquid pump 87 sends the sucked waste liquid 99, the air, and the like toward the waste liquid tank 53 via the waste liquid flow channel 73, using the driving of the pump motor 871 illustrated in FIG. 3.

The printer 1 is provided with an atmosphere communication flow channel 74. The atmosphere communication flow channel 74 is constituted by a tube, for example, and has flexibility. One end of the atmosphere communication flow channel 74 is connected to the cap 17. The other end of the atmosphere communication flow channel 74 is open to an atmosphere 90.

An atmosphere communication valve 88 is provided at the atmosphere communication flow channel 74. The atmosphere communication valve 88 can be switched between the closed state and the open state by the driving of a solenoid 881 illustrated in FIG. 3. In the closed state, the atmosphere communication valve 88 causes the atmosphere communication flow channel 74 to be in a blocked state. In the open state, the atmosphere communication valve 88 causes the atmosphere communication flow channel 74 to be in a communicated state.

With reference to FIG. 3, an electrical configuration of the printer 1 will be described. The printer 1 is provided with a control board 10. A CPU 41, a ROM 42, a RAM 43, and a flash memory 44 are provided at the control board 10. The CPU 41 controls the printer 1, and is electrically connected to the ROM 42, the RAM 43, and the flash memory 44. The ROM 42 stores a control program for controlling operations of the printer 1, information necessary for the CPU 41 to execute various programs, and the like. The RAM 43 temporarily stores various data used in the control program, and the like. The flash memory 44 is non-volatile and stores print data for performing the printing, and the like.

The main scanning motor 31, the sub-scanning motor 32, the cap motor 33, the head driver 35, the solenoids 811 to 814, 841 to 844, 861, and 881, the pump motors 821 to 824, and 871, and an operation portion 37 are electrically connected to the CPU 41. The main scanning motor 31, the sub-scanning motor 32, the cap motor 33, the head driver 35, the solenoids 811 to 814, 841 to 844, 861, and 881, and the pump motors 821 to 824, and 871 are driven under control of the CPU 41.

The operation portion 37 is a touch panel, or the like, and outputs, to the CPU 41, information corresponding to an operation by a user. The user can input, to the printer 1, a purge command to perform the purge processing, and the like by operating the operation portion 37.

With reference to FIG. 4 to FIG. 8, main processing will be described. For example, the user inputs the purge command to the printer 1 by operating the operation portion 37 illustrated in FIG. 3. When the purge command is input, the CPU 41 performs the main processing by reading out and operating the control program from the ROM 42. The purge command specifies one of the black ink, the yellow ink, the cyan ink, and the magenta ink, for example, as the ink to be purged in the single color purge processing (see FIG. 4), which will be described below.

In the following description, when the supply flow channels 72K, 72Y, 72C, and 72M themselves, the supply filters 85K, 85Y, 85C, and 85M, the supply valves 84K, 84Y, 84C, and 84M, components for connecting the supply flow channels 72K, 72Y, 72C, and 72M with the sub-tanks 51K, 51Y, 51C, and 51M, components for connecting the supply flow channels 72K, 72Y, 72C, and 72M with the head 25, and the like are collectively referred to, or when it is not specified which one of the above-described components is referred to, the components will be referred to as "components of the supply flow channels 72K, 72Y, 72C, and 72M". Further, resistances generated between the inks and the supply flow channels 72K, 72Y, 72C, and 72M when the inks flow inside the supply flow channels 72K, 72Y, 72C, and 72M will be referred to as "resistances of the supply flow channels 72K, 72Y, 72C, and 72M".

For example, when the user has replaced a component of the supply flow channel 72K, air may be mixed into the supply flow channel 72K. In this case, since the flow of the ink is inhibited by the air, the resistance of the supply flow channel 72K becomes larger.

Further, for example, when the user has replaced the component of the supply flow channel 72K, the components of the supply flow channels 72Y, 72C, and 72M are wettened with the yellow ink, the cyan ink, and the magenta ink, respectively. On the other hand, the component of the supply flow channel 72K after the replacement is not yet wettened with the black ink. For example, the length of the supply flow channel 72K may be longer than the lengths of the supply flow channels 72Y, 72C, and 72M. For example, the inner diameter of the supply flow channel 72K may be smaller than the inner diameters of the supply flow channels 72Y, 72C, and 72M. For example, due to variations in the components of the supply flow channels 72K, 72Y, 72C, and 72M, the component of the supply flow channel 72K may generate a higher resistance than the components of the supply flow channels 72Y, 72C, and 72M. For example, a viscosity of the black ink may be higher than viscosities of the yellow ink, the cyan ink, and the magenta ink. In these cases also, the resistance of the supply flow channel 72K becomes larger.

In the cases described above, the resistance of the supply flow channel 72K is likely to become larger than the resistances of the supply flow channels 72Y, 72C, and 72M. Particularly when the off-carriage tanks are used, compared with a case in which the on-carriage tanks are used, the lengths of the supply flow channels 72K, 72Y, 72C, and 72M is likely to become longer. Thus, the resistance of the supply flow channel 72K is more likely to become larger than the resistances of the supply flow channels 72Y, 72C, and 72M. In this case, if the purge processing is performed simultaneously for all of the black ink, the yellow ink, the cyan ink, and the magenta ink, there is a possibility that the black ink may be discharged less easily than the yellow ink, the cyan ink, and the magenta ink.

When there is the possibility that the black ink may be discharged less easily than the yellow ink, the cyan ink, and the magenta ink, the user inputs the purge command to the printer 1 while specifying the black ink, by operating the operation portion 37. In the following description, the main processing will be described using, as appropriate, an example in which the black ink is specified by the purge command.

Figure 4:
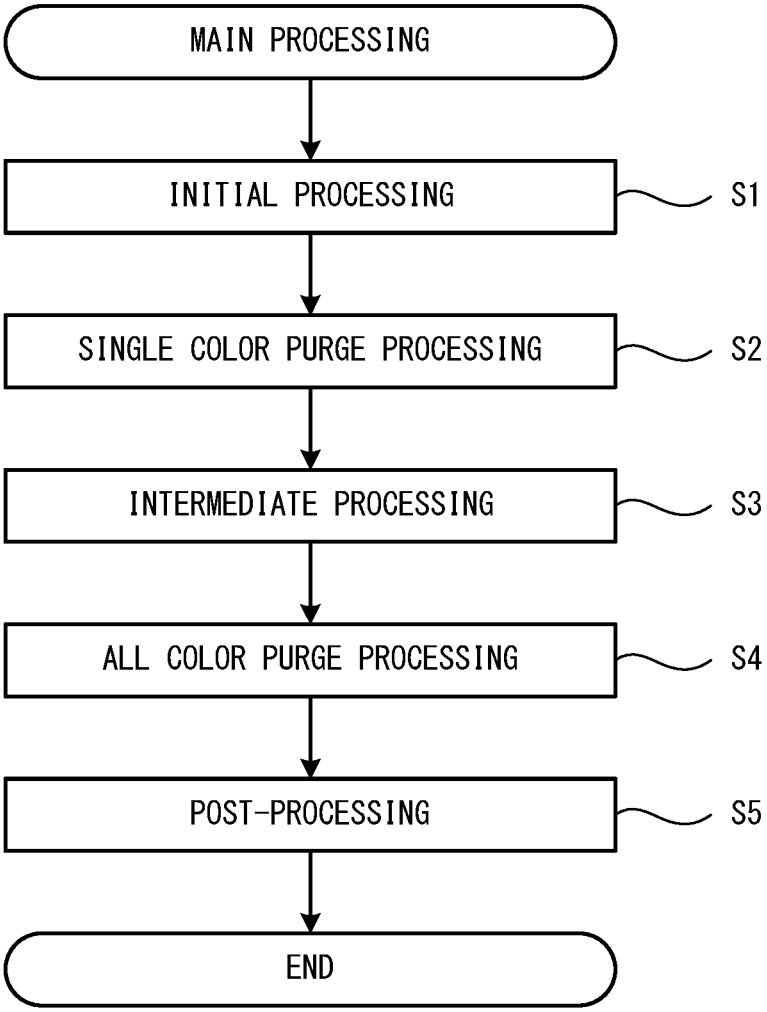
FIG. 4 is a flowchart of main processing.

As illustrated in FIG. 4, when the main processing is started, the CPU 41 performs initial processing (step S1). In the initial processing, the CPU 41 causes the printer 1 to be in an initial state illustrated in FIG. 2. For example, the CPU 41 controls the solenoids 811 to 814 illustrated in FIG. 3, and causes the tank valves 81K, 81Y, 81C, and 81M illustrated in FIG. 2 to be in the closed state. The CPU 41 controls the solenoids 841 to 844 illustrated in FIG. 3, and causes the supply valves 84K, 84Y, 84C, and 84M illustrated in FIG. 2 to be in the closed state. The CPU 41 controls the solenoid 861 illustrated in FIG. 3, and causes the waste liquid valve 86 illustrated in FIG. 2 to be in the closed state. The CPU 41 controls the solenoid 881 illustrated in FIG. 3, and causes the atmosphere communication valve 88 illustrated in FIG. 2 to be in the closed state.

The CPU stops the driving of the pump motors 821 to 824 illustrated in FIG. 3, and stops the driving of the tank pumps 82K, 82Y, 82C, and 82M illustrated in FIG. 2. The CPU stops the driving of the pump motor 871 illustrated in FIG. 3, and stops the driving of the waste liquid pump 87 illustrated in FIG. 2.

The CPU 41 controls the main scanning motor 31 illustrated in FIG. 3, and causes the heads 25 illustrated in FIG. 1 to be disposed above the caps 17. In a state in which the heads 25 are disposed above the caps 17, the CPU 41 controls the cap motor 33 illustrated in FIG. 3, and causes the caps 17 illustrated in FIG. 1 to move upward. As a result, the caps 17 are in the closely adhered state illustrated in FIG. 2. In this way, the printer 1 obtains the initial state illustrated in FIG. 2. In the present embodiment, as an example, processing at step S2 to step S5, which will be described below, is performed while the caps 17 are kept in the closely adhered state.

In the initial state, the tank valves 81K, 81Y, 81C, and 81M are in the closed state. Thus, the black ink, the yellow ink, the cyan ink, and the magenta ink are not supplied from the main tanks 52K, 52Y, 52C, and 52M to the sub-tanks 51K, 51Y, 51C, and 51M, respectively. Thus, the water head difference between the heads 25 and the sub-tanks 51K, 51Y, 51C, and 51M is stabilized. In the present embodiment, as an example, the processing at step S2 to step S5, which will be described below, is performed in a state in which the water head difference between the heads 25 and the sub-tanks 51K, 51Y, 51C, and 51M is stabilized.

The CPU 41 performs the single color purge processing (step S2). In the single color purge processing, the CPU 41 controls the solenoid corresponding to the one color ink specified by the purge command, among the solenoids 841 to 844 illustrated in FIG. 3. Accordingly, of the supply valves 84K, 84Y, 84C, and 84M illustrated in FIG. 2, the CPU 41 causes the supply valve corresponding to the controlled solenoid to be in the open state. In other words, in the single color purge processing, one of the supply valves 84K, 84Y, 84C, and 84M illustrated in FIG. 2 is caused to be in the open state, and the other three of the supply valves 84K, 84Y, 84C, and 84M are kept in the closed state.

The CPU 41 controls the solenoid 861 illustrated in FIG. 3, and causes the waste liquid valve 86 illustrated in FIG. 2 to be in the open state. The tank valves 81K, 81Y, 81C, and 81M illustrated in FIG. 2 are kept in the closed state. The atmosphere communication valve 88 illustrated in FIG. 2 is kept in the closed state.

The CPU 41 controls the pump motor 871 illustrated in FIG. 3 to drive the waste liquid pump 87 illustrated in FIG. 2, in a state in which the one of the supply valves 84K, 84Y, 84C, and 84M is in the open state, the other three of the supply valves 84K, 84Y, 84C, and 84M are in the closed state, the waste liquid valve 86 is in the open state, all the tank valves 81K, 81Y, 81C, and 81M are in the closed state, and the atmosphere communication valve 88 is in the closed state.

After driving the waste liquid pump 87 for a predetermined single color purge time period, the CPU 41 stops the driving of the pump motor 871. As a result, the driving of the waste liquid pump 87 is stopped. The single color purge time period is set by the user, for example, in accordance with an amount of the ink to be purged.

Figure 5:
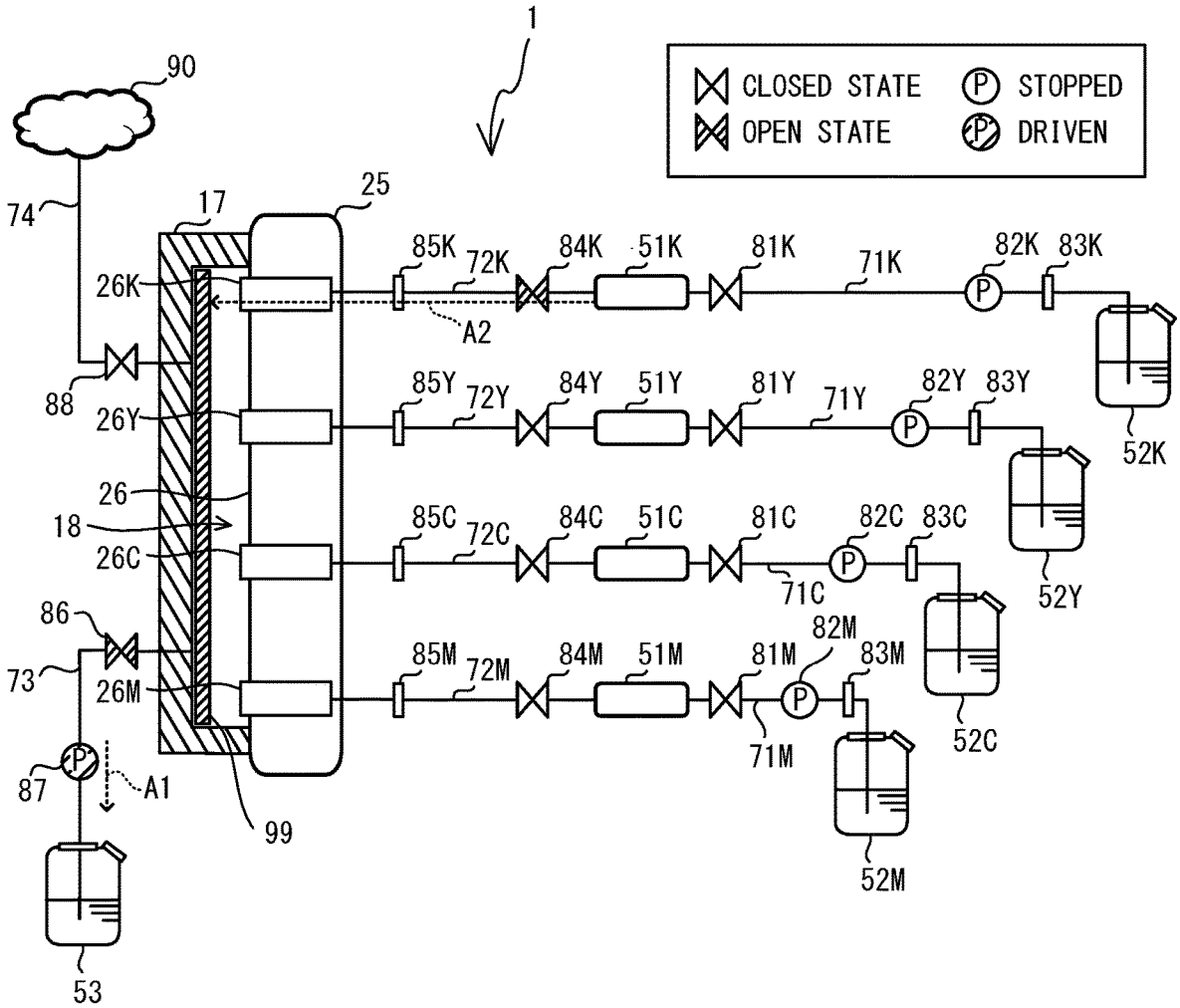
FIG. 5 is a flow channel configuration diagram of the color inks during single color purge processing.

As illustrated in FIG. 5, when the black ink is specified by the purge command, the supply valve 84K is caused to be in the open state by the single color purge processing. In this case, the supply valves 84Y, 84C, and 84M are kept in the closed state. Even when the waste liquid pump 87 is driven by the single color purge processing (see an arrow A1) in this state, since the supply valves 84Y, 84C, and 84M are in the closed state, the yellow ink, the cyan ink, and the magenta ink do not flow downstream from the sub-tanks 51Y, 51C, and 51M toward the head 25 via the supply flow channels 72Y, 72C, and 72M.

However, on the downstream side of the supply valves 84Y, 84C, and 84M, the yellow ink, the cyan ink, and the magenta ink flow downstream toward the head 25 inside the supply flow channels 72Y, 72C, and 72M. As a result, some of the yellow ink, the cyan ink, and the magenta ink present inside the respective supply flow channels 72Y, 72C, and 72M are discharged from the nozzle holes 26Y, 26C, and 26M, respectively, into the cap space 18 as the waste liquid 99.

On the other hand, since the supply valve 84K is in the open state, when the waste liquid pump 87 is driven by the single color purge processing (see the arrow A1), the black ink flows downstream from the sub-tank 51K toward the head 25 via the supply flow channel 72K, regardless of a resistance difference between the supply flow channel 72K and each of the supply flow channels 72Y, 72C, and 72M (see an arrow A2). As a result, the black ink is discharged from the nozzle hole 26K into the cap space 18 as the waste liquid 99 (see the arrow A2), and the air is removed from the interior of the supply flow channel 72K.

As illustrated in FIG. 4, the CPU 41 performs intermediate processing (step S3). In the intermediate processing, the CPU 41 controls the solenoid 861 illustrated in FIG. 3, and causes the waste liquid valve 86 illustrated in FIG. 5 to be in the closed state. The CPU 41 stops the driving of the pump motor 871 illustrated in FIG. 3, and stops the driving of the waste liquid pump 87 illustrated in FIG. 5.

The CPU 41 controls the solenoids corresponding to the color inks other than the one of the color inks specified by the purge command, among the solenoids 841 to 844 illustrated in FIG. 3. As a result, of the supply valves 84K, 84Y, 84C, and 84M illustrated in FIG. 5, the CPU 41 causes the supply valves corresponding to the controlled solenoids to be in the open state. In other words, all the supply valves 84K, 84Y, 84C, and 84M illustrated in FIG. 5 are caused to be in the open state. The tank valves 81K, 81Y, 81C, and 81M illustrated in FIG. 5 are kept in the closed state. The atmosphere communication valve 88 illustrated in FIG. 5 is kept in the closed state.

Figure 6:
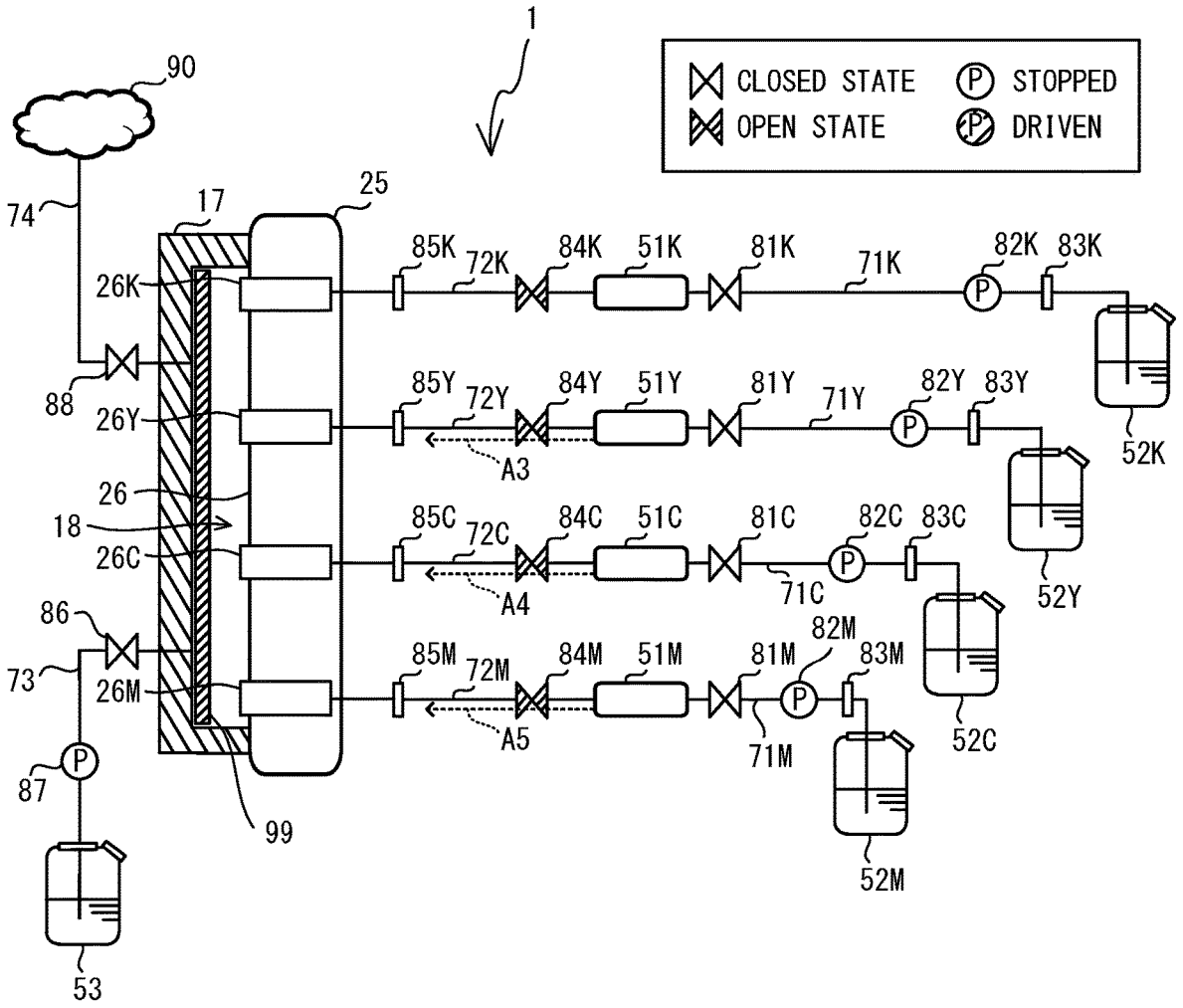
FIG. 6 is a flow channel configuration diagram of the color inks during intermediate processing.

As illustrated in FIG. 6, when the black ink is specified by the purge command, the supply valve 84K is already in the open state due to the single color purge processing. Thus, the supply valves 84Y, 84C, and 84M are additionally caused to be in the open state by the intermediate processing. As a result, all the supply valves 84K, 84Y, 84C, and 84M are in the open state.

In this case, the sub-tanks 51K, 51Y, 51C, and 51M, the supply flow channels 72K, 72Y, 72C, and 72M, and the cap space 18 are respectively communicated with one another, and form one closed space. Thus, the color inks flow such that pressures in the sub-tanks 51K, 51Y, 51C, and 51M, the supply flow channels 72K, 72Y, 72C, and 72M, and the cap space 18 become balanced out.

At a point in time when the single color purge processing is performed, a negative pressure in the supply flow channels 72Y, 72C, and 72M is larger than a negative pressure in the supply flow channel 72K. Due to the negative pressure generated in the supply flow channels 72Y, 72C, and 72M at the time of the single color purge processing, the yellow ink, the cyan ink, and the magenta ink flow downstream from the sub-tanks 51Y, 51C, and 51M toward the head 25 inside the supply flow channels 72Y, 72C, and 72M (see arrows A3 to A5).

As illustrated in FIG. 4, the CPU performs all color purge processing (step S4). In the all color purge processing, the CPU 41 controls the solenoid 861 illustrated in FIG. 3, and causes the waste liquid valve 86 illustrated in FIG. 6 to be in the open state. The supply valves 84K, 84Y, 84C, and 84M illustrated in FIG. 6 are kept in the open state. The tank valves 81K, 81Y, 81C, and 81M illustrated in FIG. 6 are kept in the closed state. The atmosphere communication valve 88 illustrated in FIG. 6 is kept in the closed state.

The CPU 41 controls the pump motor 871 illustrated in FIG. 3 to drive the waste liquid pump 87 illustrated in FIG. 6, in a state in which all the supply valves 84K, 84Y, 84C, and 84M are in the open state, the waste liquid valve 86 is in the open state, all the tank valves 81K, 81Y, 81C, and 81M are in the closed state, and the atmosphere communication valve 88 is in the closed state.

After driving the waste liquid pump 87 for a predetermined all color purge time period, the CPU 41 stops the driving of the pump motor 871. As a result, the driving of the waste liquid pump 87 is stopped. The all color purge time period is set by the user, for example, in accordance with an amount of the inks to be purged.

Figure 7:
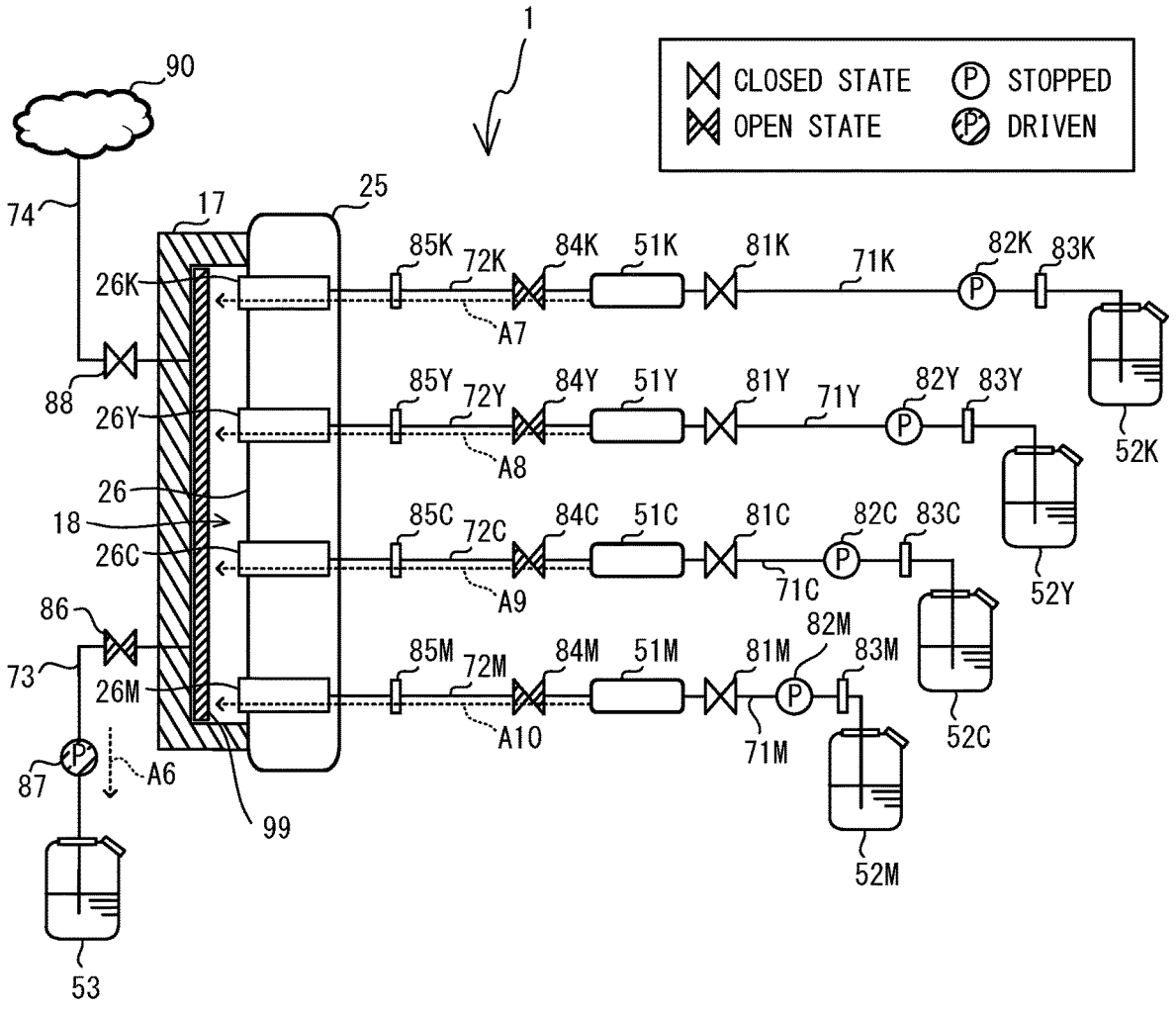
FIG. 7 is a flow channel configuration diagram of the color inks during all color purge processing.

As illustrated in FIG. 7, when the waste liquid pump 87 is driven by the all color purge processing (see an arrow A6), since all the supply valves 84K, 84Y, 84C, and 84M are in the open state, the black ink, the yellow ink, the cyan ink, and the magenta ink flow downstream from the sub-tanks 51K, 51Y, 51C, and 51M toward the head 25 inside the supply flow channels 72K, 72Y, 72C, and 72M (see arrows A7, A8, A9, and A10).

As a result, the black ink, the yellow ink, the cyan ink, and the magenta ink are discharged from the nozzle holes 26K, 26Y, 26C, and 26M into the cap space 18 as the waste liquid 99 (see the arrows A7, A8, A9, and A10), and the air is removed from the interior of the supply flow channels 72K, 72Y, 72C, and 72M.

As illustrated in FIG. 4, the CPU 41 performs post-processing (step S5). In the post-processing, the CPU 41 controls the solenoid 881 illustrated in FIG. 3, and causes the atmosphere communication valve 88 illustrated in FIG. 7 to be in the open state. The supply valves 84K, 84Y, 84C, and 84M illustrated in FIG. 7 are kept in the open state. The tank valves 81K, 81Y, 81C, and 81M illustrated in FIG. 7 are kept in the closed state. The waste liquid valve 86 illustrated in FIG. 7 is kept in the open state.

The CPU 41 controls the pump motor 871 to drive the waste liquid pump 87, in a state in which all the supply valves 84K, 84Y, 84C, and 84M are in the open state, the waste liquid valve 86 is in the open state, all the tank valves 81K, 81Y, 81C, and 81M are in the closed state, and the atmosphere communication valve 88 is in the open state.

After driving the waste liquid pump 87 for a predetermined empty suction time period, the CPU 41 stops the driving of the pump motor 871. As a result, the waste liquid pump 87 is stopped. The empty suction time period is set to a time period, for example, sufficient to discharge all the waste liquid 99 from the cap space 18 into the waste liquid tank 53 by the post-processing. The CPU 41 ends the main processing.

Figure 8:
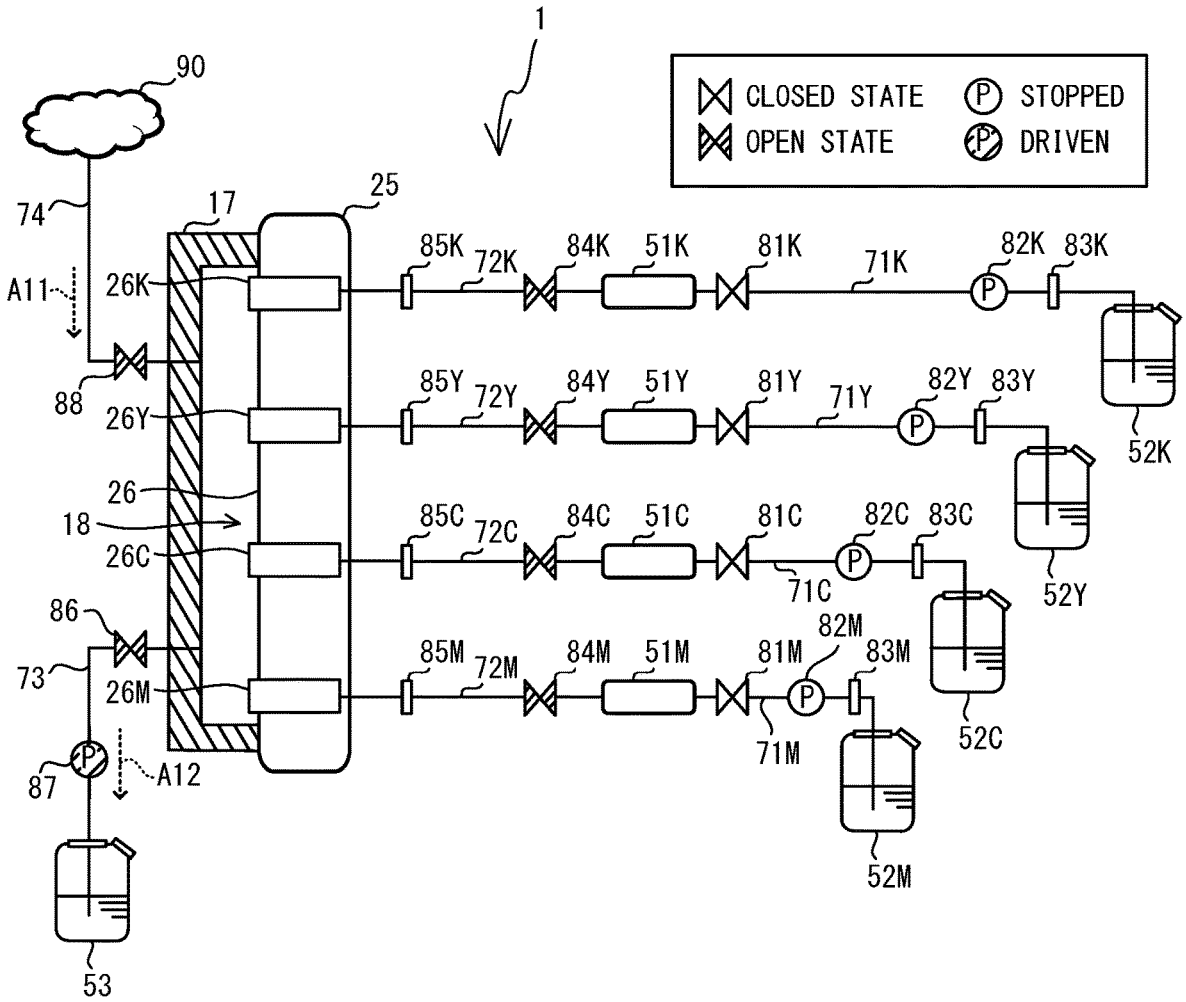
FIG. 8 is a flow channel configuration diagram of the color inks during post-processing.

As illustrated in FIG. 8, as a result of the atmosphere communication valve 88 being caused to be in the open state by the post-processing, the atmosphere 90 flows into the cap space 18 from the atmosphere communication flow channel 74 (see an arrow A11). As a result, the cap space 18 is communicated with the atmosphere 90, and atmospheric pressure is established in the cap space 18. Thus, when the waste liquid pump 87 is driven by the post-processing (see an arrow A12), the waste liquid 99 is discharged from the cap space 18 into the waste liquid tank 53 via the waste liquid flow channel 73. As a result, the printer 1 removes the waste liquid 99 attached to the cap 17 and the waste liquid 99 attached to the nozzle surface 26.

Main actions and effects of the present embodiment will be described. The description will be given below using a case, as an example, in which the supply valve 84K is caused to be in the open state and the supply valves 84Y, 84C, and 84M are caused to be in the closed state by the single color purge processing. Note that in the single color purge processing, one of the supply valves 84Y, 84C, and 84M may be caused to be in the open state. In this case also, the printer 1 can achieve the same effects as in the case in which the supply valve 84K is caused to be in the open state by the single color purge processing.

The printer 1 is provided with the sub-tanks 51K, 51Y, 51C, and 51M, the supply flow channels 72K, 72Y, 72C, and 72M, the supply valves 84K, 84Y, 84C, and 84M, the nozzle surface 26, the caps 17, the waste liquid pump 87, and the CPU 41. The sub-tanks 51K, 51Y, 51C, and 51M store the inks. The supply flow channels 72K, 72Y, 72C, and 72M connect the head 25 to the sub-tanks 51K, 51Y, 51C, and 51M. The supply valves 84K, 84Y, 84C, and 84M are provided at the supply flow channels 72K, 72Y, 72C, and 72M. The nozzle surface 26 is provided at the head 25. The nozzle holes 26K, 26Y, 26C, and 26M are provided in the nozzle surface 26. The nozzle holes 26K, 26Y, 26C, and 26M discharge the inks supplied from the supply flow channels 72K, 72Y, 72C, and 72M. The cap 17 covers the nozzle holes 26K, 26Y, 26C, and 26M, and can closely adhere to the nozzle surface 26. The waste liquid pump 87 is provided at the waste liquid flow channel 73. The waste liquid flow channel 73 is connected to the cap 17. The CPU 41 performs the single color purge processing. In the single color purge processing, the CPU 41 drives the waste liquid pump 87 in a state in which the cap 17 is closely adhered to the nozzle surface 26, the supply valve 84K is in the open state, and the supply valves 84Y, 84C, and 84M are in the closed state.

In the single color purge processing, the waste liquid pump 87 is driven, for example, in a state in which the supply valve 84K is in the open state and the supply valves 84Y, 84C, and 84M are in the closed state. Thus, the ink is discharged from the nozzle hole 26K regardless of the resistance difference between the supply flow channel 72K and each of the supply flow channels 72Y, 72C, and 72M. As a result, the printer 1 can recover the discharge capability of the nozzle hole 26K. Thus, the printer 1 can recover the discharge capability of the nozzle hole 26K regardless of the resistance difference between the supply flow channel 72K and each of the supply flow channels 72Y, 72C, and 72M. Furthermore, in the single color purge processing, since the supply valves 84Y, 84C, and 84M are in the closed state, a suction force of the waste liquid pump 87 mainly acts on the supply flow channel 72K. Thus, compared with a case in which the supply valves 84Y, 84C, and 84M are in the open state as well as the supply valve 84K, a flow rate of the ink inside the supply flow channel 72K becomes greater. Thus, the printer 1 can recover the discharge capability of the nozzle hole 26K in a quicker and more reliable manner.

After performing the single color purge processing, the CPU 41 performs the all color purge processing. In the all color purge processing, the CPU 41 drives the waste liquid pump 87 in a state in which the cap 17 is closely adhered to the nozzle surface 26 and all the supply valves 84K, 84Y, 84C, and 84M are in the open state.

In the single color purge processing, since the supply valves 84Y, 84C, and 84M are in the closed state, the negative pressure is generated in sections, of the supply flow channels 72Y, 72C, and 72M, extending from the supply valves 84Y, 84C, and 84M to the nozzle holes 26Y, 26C, and 26M, respectively. Due to that negative pressure, there is a possibility that the inks or the air may return from the nozzle holes 26Y, 26C, and 26M to the sections, of the supply flow channels 72Y, 72C, and 72M, extending from the supply valves 84Y, 84C, and 84M to the nozzle holes 26Y, 26C, and 26M, respectively. In the all color purge processing, all the supply valves 84K, 84Y, 84C, and 84M are in the open state. Thus, the inks are discharged from the nozzle holes 26Y, 26C, and 26M as well as from the nozzle hole 26K. Thus, by performing the all color purge processing after performing the single color purge processing, the printer 1 can recover the discharge capability of the nozzle holes 26Y, 26C, and 26M as well as the discharge capability of the nozzle hole 26K. Furthermore, when the air is removed from the interior of the supply flow channel 72K by the single color purge processing, the resistance difference between the supply flow channel 72K and each of the supply flow channels 72Y, 72C, and 72M is reduced compared with the resistance difference before the single color purge processing. After the resistance difference between the supply flow channel 72K and each of the supply flow channels 72Y, 72C, and 72M is reduced, the all color purge processing is performed. Thus, the printer 1 can recover the discharge capability of the nozzle holes 26K, 26Y, 26C, and 26M in a more stable manner compared with a case in which the single color purge processing is performed after the all color purge processing.

After performing the single color purge processing, the CPU 41 performs the post-processing. In the post-processing, the CPU 41 drives the waste liquid pump 87 in a state in which the cap space 18 between the cap 17 and the nozzle surface 26 is communicated with the atmosphere 90.

By driving the waste liquid pump 87 in a state in which the cap space 18 is communicated with the atmosphere 90, the printer 1 removes the inks from the cap space 18 in the post-processing. As a result, the printer 1 can remove the waste liquid 99 attached to the cap 17 and the waste liquid 99 attached to the nozzle surface 26, for example. Thus, the printer 1 can inhibit the waste liquid 99 from flowing back into the supply flow channels 72K, 72Y, 72C, and 72M due to the negative pressure in the supply flow channels 72K, 72Y, 72C, and 72M.

The printer 1 is provided with the atmosphere communication valve 88. The atmosphere communication valve 88 is provided at the atmosphere communication flow channel 74. The atmosphere communication flow channel 74 is connected to the cap 17 and is communicated with the atmosphere 90. In the post-processing, the CPU 41 opens the atmosphere communication valve 88 to cause the cap space 18 between the cap 17 and the nozzle surface 26 to be in a state of being communicated with the atmosphere 90.

For example, when a negative pressure is generated in the cap space 18, a significant force is required to separate the cap 17 downwardly from the nozzle surface 26. The printer 1 can cause the cap space 18 to be communicated with the atmosphere 90 using a simple configuration, namely, by simply opening and closing the atmosphere communication valve 88. Further, since the cap 17 remains closely adhered to the nozzle surface 26, the waste liquid 99 inside the cap space 18 is unlikely to spill from the cap 17. Thus, the printer 1 can inhibit a malfunction of the printer 1 from arising due to attachment of the waste liquid 99 to a component of the printer 1.

The CPU 41 performs the intermediate processing between the single color purge processing and the all color purge processing. In the intermediate processing, the CPU 41 stops the driving of the waste liquid pump 87, and causes all the supply valves 84K, 84Y, 84C, and 84M to be in the open state.

Since all the supply valves 84K, 84Y, 84C, and 84M are caused to be in the open state by the intermediate processing, the pressures in the supply flow channels 72K, 72Y, 72C, and 72M become balanced out. For example, when the supply flow channel 72K is purged by the single color purge processing, the negative pressure is generated in the sections, of the supply flow channels 72Y, 72C, and 72M, downstream of the supply valves 84Y, 84C, and 84M. As a result of the inks being supplied from the sub-tanks 51Y, 51C, and 51M to the supply flow channels 72Y, 72C, and 72M by the intermediate processing, the above-described negative pressure is reduced. Thus, the printer 1 can inhibit the purging of the supply flow channel 72K by the single color purge processing from causing the waste liquid 99 to flow back into the supply flow channels 72Y, 72C, and 72M. Furthermore, in this state, the all color purge processing is performed. Thus, by performing the intermediate processing, in the all color purge processing, the printer 1 can inhibit a pressure difference between the supply flow channel 72K and each of the supply flow channels 72Y, 72C, and 72M from causing the waste liquid 99 to flow back into the supply flow channels 72Y, 72C, and 72M.

The supply flow channels 72K, 72Y, 72C, and 72M are provided with the supply filters 85K, 85Y, 85C, and 85M.

For example, when replacing the supply filter 85K, the resistance difference between the supply flow channel 72K and each of the supply flow channels 72Y, 72C, and 72M is likely to be generated. In this case, for example, for a reason such that the supply filter 85K is not wettened with the ink, or that air is mixed into the supply flow channel 72K when replacing the supply filter 85K, the resistance of the supply flow channel 72K is likely to become larger than the resistances of the supply flow channels 72Y, 72C, and 72M. The printer 1 can perform the single color purge processing with the supply valve 84K in the open state. In this case, even if there is the resistance difference between the supply flow channel 72K and each of the supply flow channels 72Y, 72C, and 72M, the printer 1 can recover the discharge capability of the nozzle hole 26K.

The sub-tanks 51K, 51Y, 51C, and 51M are connected to the main tanks 52K, 52Y, 52C, and 52M via the tank flow channels 71K, 71Y, 71C, and 71M. The main tanks 52K, 52Y, 52C, and 52M store the inks.

If, for example, the sub-tanks 51K, 51Y, 51C, and 51M are not provided, and the inks flow from the main tanks 52K, 52Y, 52C, and 52M to the head 25 via the tank flow channels 71K, 71Y, 71C, and 71M and the supply flow channels 72K, 72Y, 72C, and 72M, in the single color purge processing, it is possible that the ink may be required not only for the supply flow channel 72K, but also for the tank flow channel 71K. Since the printer 1 does not require the ink for the tank flow channel 71K, an amount of the ink consumed by the single color purge processing can be reduced.

The printer 1 is provided with the tank valves 81K, 81Y, 81C, and 81M. The tank valves 81K, 81Y, 81C, and 81M are provided at the tank flow channels 71K, 71Y, 71C, and 71M. The CPU 41 performs the single color purge processing with the tank valve 81K in the closed state.

For example, when the supply valve 84K is in the open state, the printer 1 performs the single color purge processing with the tank valve 81K in the closed state. In this case, the printer 1 can inhibit the ink from being supplied from the main tank 52K to the sub-tank 51K during the single color purge processing. Specifically, the printer 1 can perform the single color purge processing while stabilizing the water head difference between the head 25 and the sub-tank 51K. Thus, the printer 1 can recover the discharge capability of the nozzle hole 26K in a stable manner.

The sub-tanks 51K, 51Y, 51C, and 51M are provided at positions different from that of the carriage 23. The carriage 23 supports the head 25.

The head 25 is disposed at a position separated from the sub-tanks 51K, 51Y, 51C, and 51M. Thus, the lengths of the supply flow channels 72K, 72Y, 72C, and 72M become longer. The longer the supply flow channels 72K, 72Y, 72C, and 72M, the more likely the resistance difference between the supply flow channel 72K and each of the supply flow channels 72Y, 72C, and 72M is to become larger. By performing the single color purge processing, the printer 1 can recover the discharge capability of the nozzle hole 26K regardless of the resistance difference between the supply flow channel 72K and each of the supply flow channels 72Y, 72C, and 72M.

The present disclosure can be changed from the above-described embodiment. Various modified examples, which will be described below, can be combined with one another as long as no contradictions arise. For example, in the above-described embodiment, the plurality of main tanks 52 and the plurality of sub-tanks 51 may be the on-carriage tanks. In this case, the length from the upstream end to the downstream end of each of the supply flow channels 72K, 72Y, 72C, and 72M may be shorter than the length from the left end to the right end of the movement range of the head 25. The head 25 may be a line head.

In the above-described embodiment, in the waste liquid flow channel 73, the waste liquid pump 87 is provided closer to the waste liquid tank 53 than the waste liquid valve 86. In contrast to this, in the waste liquid flow channel 73, the waste liquid pump 87 may be provided closer to the cap 17 than the waste liquid valve 86. The waste liquid valve 86 may be omitted.

In the above-described embodiment, in each of the processing at step S1 to step S5, the CPU 41 can change the order of controlling the solenoids 811 to 814, 841 to 844, 861, and 881 as appropriate. For example, in the processing at step S2, it is sufficient that the CPU 41 control one of the solenoids 841 to 844, and the solenoid 861 before driving the waste liquid pump 87. In other words, in the processing at step S2, the CPU 41 may control the one of the solenoids 841 to 844 before the solenoid 861, or may control the solenoid 861 before the one of the solenoids 841 to 844.

In the above-described embodiment, after temporarily stopping the driving of the waste liquid pump 87 in the processing at step S4, the CPU 41 restarts the driving of the waste liquid pump 87 in the processing at step S5. In contrast to this, the CPU 41 may cause the atmosphere communication valve 88 to be in the open state in the processing at step S5, while maintaining the driving of the waste liquid pump 87 in the processing at step S4.

In the above-described embodiment, the CPU 41 may omit some or all of the processing at step S3 to step S5. In the above-described embodiment, a method for setting the lengths of the single color purge time period, the all color purge time period, and the empty suction time period can be changed as appropriate. For example, the single color purge time period, the all color purge time period, and the empty suction time period may be set in accordance with an amount of the ink to be purged. For example, the CPU 41 may stop the driving of the pump motor 871 when the user inputs a purge termination command to the printer 1.

In the above-described embodiment, the CPU 41 performs the series of processing at step S1 to step S5 when the purge command is input. In contrast to this, the CPU 41 may perform the processing at step S1 to step S5 when an execution command for each of the processing at step S1 to step S5 is input, for example.

In the above-described embodiment, the head 25 discharges the inks having mutually different colors from the nozzle holes 26K, 26Y, 26C, and 26M, respectively. In contrast to this, the head 25 may discharge the inks having the same color from the nozzle holes 26K, 26Y, 26C, and 26M, respectively. For example, the head 25 may discharge the white ink from the nozzle holes 26K, 26Y, 26C, and 26M, respectively. In this case, it is sufficient that the white ink be stored in the sub-tanks 51K, 51Y, 51C, and 51M. Further, the number of main tanks may be one, for example. In other words, the printer 1 may have a configuration in which the white ink is supplied from the single main tank to the plurality of sub-tanks 51K, 51Y, 51C, and 51M, respectively.

The head 25 may include a plurality of individual heads. In this case, individual nozzle surfaces are respectively formed at the plurality of individual heads. For example, the nozzle hole 26K is provided in a first individual nozzle surface. The nozzle hole 26Y is provided in a second individual nozzle surface. The nozzle hole 26C is provided in a third individual nozzle surface. The nozzle hole 26M is provided in a fourth individual nozzle surface. The plurality of individual nozzle surfaces form the nozzle surface 26 as a whole.

In the above-described embodiment, the inks are supplied from the main tanks 52K, 52Y, 52C, and 52M to the head 25 via the sub-tanks 51K, 51Y, 51C, and 51M. In contrast to this, the inks may be supplied from the main tanks 52K, 52Y, 52C, and 52M to the head 25 without passing through the sub-tanks 51K, 51Y, 51C, and 51M.

In the above-described embodiment, in the post-processing, the interior of the cap space 18 is communicated with the atmosphere 90 as a result of the atmosphere communication valve 88 being caused to be in the open state. In contrast to this, the CPU 41 may cause the cap 17 to move downward by controlling the cap motor 33, for example. In this case, as a result of the cap 17 being separated from the nozzle surface 26, the interior of the cap space 18 is communicated with the atmosphere 90 via a gap between the cap 17 and the nozzle surface 26.

In the above-described embodiment, the cap 17 is caused to be in the closely adhered state as a result of the cap 17 moving upward in the state in which the head 25 is positioned above the cap 17. In contrast to this, the cap 17 may be brought into the closely adhered state as a result of the head 25 moving downward in the state in which the head 25 is positioned above the cap 17.

In the above-described embodiment, the cap 17 covers all the nozzle holes 26K, 26Y, 26C, and 26M in the closely adhered state. In contrast to this, the cap 17 may cover at least two of the nozzle holes 26K, 26Y, 26C, and 26M in the closely adhered state. For example, when the cap 17 covers the two nozzle holes 26K and 26Y, the CPU 41 may perform the single color purge processing in a state in which one of the two supply valves 84K and 84Y is in the open state, and the other of the two supply valves 84K and 84Y is in the closed state, and may perform the intermediate processing, the all color purge processing, and the post-processing in a state in which the two supply valves 84K and 84Y are both in the open state. For example, two of the caps 17 may be used for the single head 25.

In the above-described embodiment, the purge command specifies one of the black ink, the yellow ink, the cyan ink, and the magenta ink, as the ink to be purged in the single color purge processing. In contrast to this, the purge command may specify two or three of the black ink, the yellow ink, the cyan ink, and the magenta ink, as the inks to be purged in the single color purge processing.

In this case, in the single color purge processing, the supply valves corresponding to the two or three specified color inks are caused to be in the open state. In other words, two or three of the supply valves 84K, 84Y, 84C, and 84M are caused to be in the open state, and the other one or two of the supply valves 84K, 84Y, 84C, and 84M are kept in the closed state. Specifically, in the single color purge processing, it is sufficient that at least one of the supply valves 84K, 84Y, 84C, and 84M be in the closed state, and at least one of the supply valves 84K, 84Y, 84C, and 84M be in the open state.

In the above-described embodiment, in the all color purge processing, all the supply valves 84K, 84Y, 84C, and 84M are caused to be in the open state. In contrast to this, in the all color purge processing, in addition to the supply valve that is caused to be in the open state in the single color purge processing, some of the plurality of supply valves that are caused to be in the closed state in the single color purge processing may be caused to be in the open state.

In the above-described embodiment, the supply filters 85K, 85Y, 85C, and 85M are provided at the supply flow channels 72K, 72Y, 72C, and 72M, respectively. In contrast to this, some or all of the supply filters 85K, 85Y, 85C, and 85M may be omitted. The supply filters 85K, 85Y, 85C, and 85M may be provided upstream of the supply valves 84K, 84Y, 84C, and 84M, respectively. The tank filters 83K, 83Y, 83C, and 83M can also be changed in the same manner.

In the above-described embodiment, during the processing at step S1 to step S5, all the tank valves 81K, 81Y, 81C, and 81M are in the closed state. In contrast to this, in some or all of the processing at step S1 to step S5, the CPU 41 may control the solenoids 811 to 814 to cause some or all of the tank valves 81K, 81Y, 81C, and 81M to be in the open state.

For example, the CPU 41 may perform the processing at one or both of step S2 and step S4 in a state in which the tank valve corresponding to the supply valve in the closed state is in the open state. As an example, when the supply valves 84Y, 84C, and 84M are in the closed state, the CPU 41 may perform the processing at one or both of step S2 and step S4 in a state in which the tank valves 81Y, 81C, and 81M are in the open state.

For example, during the processing at step S1 to step S5, all the tank valves 81K, 81Y, 81C, and 81M may be in the open state. For example, the CPU 41 may perform the processing at one or both of step S2 and step S4 in a state in which the tank valve corresponding to the supply valve in the open state is in the open state. As an example, in the processing at step S2, when the supply valve 84K is in the open state, the CPU 41 may drive the waste liquid pump 87 with the tank valve 81K in the open state. In this case, in the processing at step S2, the CPU 41 may drive the pump motor 821 to drive the tank pump 82K.

The printer 1 is provided with the tank valves 81K, 81Y, 81C, and 81M. The tank valves 81K, 81Y, 81C, and 81M are provided at the tank flow channels 71K, 71Y, 71C, and 71M. The CPU 41 performs the single color purge processing with the tank valve 81K in the open state.

For example, when the supply valve 84K is in the open state, the printer 1 performs the single color purge processing with the tank valve 81K in the open state. In this case, during the single color purge processing, the printer 1 can supply the black ink from the main tank 52K to the sub-tank 51K. Specifically, during the single color purge processing, the printer 1 can inhibit the black ink inside the sub-tank 51K from running out and the sub-tank 51K becoming empty. Thus, the printer 1 can perform the single color purge processing using a large amount of the black ink, for example. As a result, the printer 1 can recover the discharge capability of the nozzle hole 26K in a more reliable manner.

In place of the CPU 41, a microcomputer, application specific integrated circuits (ASICs), a field programmable gate array (FPGA) or the like may be used as a processor. The main processing may be performed as distributed processing by a plurality of the processors. It is sufficient that the non-transitory storage media, such as the ROM 42, the flash memory 44, and the like be a storage medium capable of storing information, regardless of a period of storing the information. The non-transitory storage medium need not necessarily include a transitory storage medium (a transmitted signal, for example). The control program may be downloaded from a server connected to a network (not shown in the drawings) (in other words, may be transmitted as transmission signals), and may be stored in the ROM 42 or the flash memory 44. In this case, the control program may be stored in a non-transitory storage medium, such as an HDD provided in the server.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a first tank and a second tank configured to store ink;

a first supply flow channel configured to connect a head with the first tank;

a second supply flow channel configured to connect the head with the second tank;

a first supply valve provided at the first supply flow channel;

a second supply valve provided at the second supply flow channel;

a nozzle surface provided with a first nozzle hole configured to discharge the ink supplied from the first supply flow channel and a second nozzle hole configured to discharge the ink supplied from the second supply flow channel, the nozzle surface being a surface provided at the head;

a cap configured to cover the first nozzle hole and the second nozzle hole and to be closely adhered to the nozzle surface;

a pump provided at a waste liquid flow channel connected to the cap;

a processor; and a memory storing computer-readable instructions that, when executed by the processor, cause the processor to perform processes comprising:

first purge processing of driving the pump in a state in which the cap is closely adhered to the nozzle surface, one of the first supply valve or the second supply valve is open, and the other of the first supply valve or the second supply valve is closed, and second purge processing of driving the pump in a state in which the cap is closely adhered to the nozzle surface, and both the first supply valve and the second supply valve are open, the second purge processing being performed after the first purge processing.

2. A printer comprising:

a first tank and a second tank configured to store ink;

a first supply flow channel configured to connect a head with the first tank;

a second supply flow channel configured to connect the head with the second tank;

a first supply valve provided at the first supply flow channel;

a second supply valve provided at the second supply flow channel;

a nozzle surface provided with a first nozzle hole configured to discharge the ink supplied from the first supply flow channel and a second nozzle hole configured to discharge the ink supplied from the second supply flow channel, the nozzle surface being a surface provided at the head;

a cap configured to cover the first nozzle hole and the second nozzle hole and to be closely adhered to the nozzle surface;

a pump provided at a waste liquid flow channel connected to the cap;

an atmosphere communication valve provided at an atmosphere communication flow channel communicated with the atmosphere, the atmosphere communication flow channel being a flow channel connected to the cap;

a processor; and a memory storing computer-readable instructions that, when executed by the processor, cause the processor to perform processes comprising:

first purge processing of driving the pump in a state in which the cap is closely adhered to the nozzle surface, one of the first supply valve or the second supply valve is open, and the other of the first supply valve or the second supply valve is closed, and post-processing of opening the atmosphere communication valve to cause a space between the cap and the nozzle surface to be communicated with an atmosphere and driving the pump in a state in which the space between the cap and the nozzle surface is communicated with the atmosphere, the post-processing being performed after the first purge processing.

3. The printer according to claim 1, wherein the computer-readable instructions stored in the memory further cause the processor to perform a process comprising:

intermediate processing of stopping the driving of the pump and causing both the first supply valve and the second supply valve to be open, the intermediate processing being performed between the first purge processing and the second purge processing.

4. The printer according to claim 1, wherein at least one of the first supply flow channel or the second supply flow channel is provided with a filter.

5. A printer comprising:

a first tank and a second tank configured to store ink;

a first supply flow channel configured to connect a head with the first tank;

a second supply flow channel configured to connect the head with the second tank;

a first supply valve provided at the first supply flow channel;

a second supply valve provided at the second supply flow channel;

a nozzle surface provided with a first nozzle hole configured to discharge the ink supplied from the first supply flow channel and a second nozzle hole configured to discharge the ink supplied from the second supply flow channel, the nozzle surface being a surface provided at the head;

a cap configured to cover the first nozzle hole and the second nozzle hole and to be closely adhered to the nozzle surface;

a pump provided at a waste liquid flow channel connected to the cap;

a processor; and a memory storing computer-readable instructions that, when executed by the processor, cause the processor to perform a process comprising:

first purge processing of driving the pump in a state in which the cap is closely adhered to the nozzle surface, one of the first supply valve or the second supply valve is open, and the other of the first supply valve or the second supply valve is closed, wherein the first tank is a first sub-tank connected, via a first tank flow channel, to a first main tank configured to store the ink, and the second tank is a second sub-tank connected, via a second tank flow channel, to a second main tank configured to store the ink.

6. The printer according to claim 5, further comprising:

a first tank valve provided at the first tank flow channel; and a second tank valve provided at the second tank flow channel, wherein the computer-readable instructions stored in the memory further cause the processor to perform the first purge processing in a state in which, of the first tank valve and the second tank valve, a tank valve is closed, the tank valve corresponding to a supply valve being open, of the first supply valve and the second supply valve.

7. The printer according to claim 5, further comprising:

a first tank valve provided at the first tank flow channel; and a second tank valve provided at the second tank flow channel, wherein the computer-readable instructions stored in the memory further cause the processor to perform the first purge processing in a state in which, of the first tank valve and the second tank valve, a tank valve is open, the tank valve corresponding to a supply valve being open, of the first supply valve and the second supply valve.

8. A printer comprising:

a first tank and a second tank configured to store ink;

a first supply flow channel configured to connect a head with the first tank;

a second supply flow channel configured to connect the head with the second tank;

a first supply valve provided at the first supply flow channel;

a second supply valve provided at the second supply flow channel;

a nozzle surface provided with a first nozzle hole configured to discharge the ink supplied from the first supply flow channel and a second nozzle hole configured to discharge the ink supplied from the second supply flow channel, the nozzle surface being a surface provided at the head;

a cap configured to cover the first nozzle hole and the second nozzle hole and to be closely adhered to the nozzle surface;

a pump provided at a waste liquid flow channel connected to the cap;

a processor; and a memory storing computer-readable instructions that, when executed by the processor, cause the processor to perform a process comprising:

first purge processing of driving the pump in a state in which the cap is closely adhered to the nozzle surface, one of the first supply valve or the second supply valve is open, and the other of the first supply valve or the second supply valve is closed, wherein the first tank and the second tank are provided at positions different from a position of a carriage configured to support the head.

9. A control method, comprising:

first purge processing of driving a pump provided at a waste liquid flow channel, the waste liquid flow channel being connected to a cap, the cap being configured to cover a first nozzle hole and a second nozzle hole of a nozzle surface provided at a head, and the cap being configured to be closely adhered to the nozzle surface, the first nozzle hole being configured to discharge ink supplied from a first supply flow channel connecting the head and a first tank, the second nozzle hole being configured to discharge ink supplied from a second supply flow channel connecting the head and a second tank, the first purge processing being performed in a state in which the cap is closely adhered to the nozzle surface, and in which one of a first supply valve provided in the first supply flow channel or a second supply valve provided in the second supply flow channel is open, and the other of the first supply valve or the second supply valve is closed, the first tank and the second tank being provided at positions different from a position of a carriage configured to support the head.

10. The control method according to claim 9, further comprising:

second purge processing of driving the pump in a state in which the cap is closely adhered to the nozzle surface, and both the first supply valve and the second supply valve are open, the second purge processing being performed after the first purge processing.

11. The control method according to claim 9, further comprising:

post-processing of driving the pump in a state in which a space between the cap and the nozzle surface is communicated with an atmosphere, the post-processing being performed after the first purge processing.

12. The control method according to claim 11, further comprising:

the post-processing of opening an atmosphere communication valve to cause a space between the cap and the nozzle surface to be communicated with an atmosphere and driving the pump in the state in which the space between the cap and the nozzle surface is communicated with an atmosphere, the atmosphere communication valve provided at an atmosphere communication flow channel communicated with the atmosphere, the atmosphere communication flow channel being a flow channel connected to the cap.

13. The control method according to claim 9, wherein the first tank is a first sub-tank connected, via a first tank flow channel, to a first main tank configured to store the ink, and the second tank is a second sub-tank connected, via a second tank flow channel, to a second main tank configured to store the ink.

14. A non-transitory computer-readable medium storing computer-readable instructions that, when executed by a processor of a computer, cause the computer to perform a process comprising:

first purge processing of driving a pump provided at a waste liquid flow channel, the waste liquid flow channel being connected to a cap, the cap being configured to cover a first nozzle hole and a second nozzle hole of a nozzle surface provided at a head, and the cap being configured to be closely adhered to the nozzle surface, the first nozzle hole being configured to discharge ink supplied from a first supply flow channel connecting the head and a first tank, the second nozzle hole being configured to discharge ink supplied from a second supply flow channel connecting the head and a second tank, the first purge processing being performed in a state in which the cap is closely adhered to the nozzle surface, and in which one of a first supply valve provided in the first supply flow channel or a second supply valve provided in the second supply flow channel is open, and the other of the first supply valve or the second supply valve is closed, the first tank and the second tank being provided at positions different from a position of a carriage configured to support the head.

15. The non-transitory computer-readable medium storing computer-readable instructions according to claim 12, wherein the instructions further cause the computer to perform a process comprising:

second purge processing of driving the pump in a state in which the cap is closely adhered to the nozzle surface, and both the first supply valve and the second supply valve are open, the second purge processing being performed after the first purge processing.

16. The non-transitory computer-readable medium storing computer-readable instructions according to claim 14, wherein the instructions further cause the computer to perform a process comprising:

post-processing of driving the pump in a state in which a space between the cap and the nozzle surface is communicated with an atmosphere, the post-processing being performed after the first purge processing.

17. The non-transitory computer-readable medium storing computer-readable instructions according to claim 16, wherein the post-processing further includes opening an atmosphere communication valve to cause a space between the cap and the nozzle surface to be communicated with an atmosphere and driving the pump in the state in which the space between the cap and the nozzle surface is communicated with an atmosphere, the atmosphere communication valve provided at an atmosphere communication flow channel communicated with the atmosphere, the atmosphere communication flow channel being a flow channel connected to the cap.

18. The non-transitory computer-readable medium storing computer-readable instructions according to claim 14, wherein the first tank is a first sub-tank connected, via a first tank flow channel, to a first main tank configured to store the ink, and the second tank is a second sub-tank connected, via a second tank flow channel, to a second main tank configured to store the ink.

* * * * *